US006478152B1

(12) United States Patent
Mansfield

(10) Patent No.: US 6,478,152 B1
(45) Date of Patent: Nov. 12, 2002

(54) BEVERAGE PACKAGE WITH SOUND EFFECTS

(76) Inventor: Harold D. Mansfield, 918 Blvd. of the Arts, Sarasota, FL (US) 34236

( * ) Notice: Subject to any disclaimer, the term of this patent is extended or adjusted under 35 U.S.C. 154(b) by 0 days.

(21) Appl. No.: 09/880,164

(22) Filed: Jun. 13, 2001

(51) Int. Cl.[7] ..... B65D 33/00

(52) U.S. Cl. ..... 206/446; 206/459.1; 340/568.1

(58) Field of Search ..... 84/600; 206/216, 206/217, 446, 457, 459.1; 340/568.1, 568.7, 568.8, 571, 666

(56) References Cited

U.S. PATENT DOCUMENTS

| | | | | |
|---|---|---|---|---|
| 4,221,927 A | | 9/1980 | Dankman et al. | 179/1 VC |
| 4,428,484 A | | 1/1984 | Rattay et al. | 207/548 |
| 4,904,988 A | | 2/1990 | Nesbit et al. | 340/628 |
| 4,964,831 A | | 10/1990 | Wolff | 446/75 |
| 5,055,084 A | | 10/1991 | Lokic | 446/486 |
| 5,083,961 A | | 1/1992 | Ishiwa | 446/75 |
| 5,134,796 A | | 8/1992 | Satoh et al. | 40/414 |
| 5,160,000 A | * | 11/1992 | Agha et al. | 340/568.1 |
| 5,182,872 A | | 2/1993 | Lee et al. | 40/152 |
| 5,184,971 A | | 2/1993 | Williams | 446/142 |
| 5,344,034 A | * | 9/1994 | Eagan | 84/600 |
| 5,353,378 A | | 10/1994 | Hoffman et al. | 395/2.81 |
| 5,359,374 A | | 10/1994 | Schwartz | 354/76 |
| 5,451,180 A | | 9/1995 | Chan et al. | 446/357 |
| 5,536,196 A | | 7/1996 | Sternberg | 446/81 |
| 5,795,209 A | | 8/1998 | Moore | 446/73 |
| 6,020,823 A | * | 2/2000 | DeCicco | 206/459.1 |
| 6,107,928 A | * | 8/2000 | Gatti | 340/568.1 |
| 6,137,410 A | | 10/2000 | Sepulveda | 340/568.7 |
| 6,158,588 A | * | 12/2000 | Conti | 206/459.1 |

* cited by examiner

*Primary Examiner*—Jim Foster
(74) *Attorney, Agent, or Firm*—Mark Douma

(57) ABSTRACT

A beverage package that in one embodiment can be described as a musical wine bag has a sound emitting device that plays a tune when a beverage container is pressed into the beverage package. The sound emitting device is commercially available and has an integral switch that is actuated by pressing, e.g., the top and bottom of the device together. A specially designed locator positions the sound emitting device underneath it in the bottom of the beverage package and positions beverage containers so that the sound emitting device speaker is not covered. The locator is further designed to orient beverage containers into upright positions and transmit sufficient force from smaller ones sited away from the sound emitting device to actuate the device.

20 Claims, 3 Drawing Sheets

BEVERAGE PACKAGE WITH SOUND EFFECTS

BACKGROUND

1. Technical Field

This invention relates to a beverage package that can produce sound effects such as songs, melodies, or another message. As an example, a wine bag has a sound emitting device located inside that plays a song when a wine bottle in the bag is pushed downward.

2. Background

Amusement devices that use a sound emitting device comprising an integrated circuit connected to a small speaker to play a short message with sound effects are well known. For example, toy ambulances that emit a siren sound along with short phrases were popular children's toys at the time this invention was made. Also, well known were birthday cards that play "Happy Birthday" when opened.

Combinations of sound emitting devices and packaging are also known. For example, U.S. Pat. No. 6,137,410, issued to Sepulveda on Oct. 24, 2000, entitled "Bag with Sound Emitting Device," discloses a festive bag having a U-shaped pair of handles that have metal plates on the inside of the handles. When the handles are separated, electrical contact between the metal plates is broken and a sound emitting device located in the interior of the bag is activated.

U.S. Pat. No. 5,795,209, issued to Moore on Aug. 18, 1998, entitled "Package Amusement Device and Method," discloses a detection means, integrated with a packaging means, for detecting an interaction, e.g., touch, with the packaging means that is electrically connected to a microprocessor means that can generate a (human) sense detectible signal, e.g., sound. When the packaging means is a box, the detection means is a transducer mounted antipodal to the microprocessor means. The transducer and a battery appear to be mounted underneath the top and a microprocessor speech chip and speaker mounted in the bottom. Activation of the transducer causes the production of sound from a position away from the transducer's position. Another example is an egg shell-type package having multiple detectors.

In spite of considerable interest in coupling sound emitting devices with packaging, there does not seem to be any commercially available examples, at least not with packaging suitable for containing beverage bottles, such as wine and the like. Since the retail price of such packaging can be as low as a few 2001 dollars, the manufactured cost must be appreciably less than a dollar. This puts a premium on using off the shelf components requiring minimal assembly. Having a sound emitting unit connected by wires to a remote switch increases the degrees of design freedom, but in a paper bag will require tape or other attachment means to keep the wires from intruding into the carrying space of the bag.

SUMMARY OF THE INVENTION

Accordingly, the major objective of the invention is to provide a beverage package with a sound emitting device that can be assembled with minimal labor using a minimum number of parts that will play a tune or other sound emission when a beverage container is pressed into the package. Using wine as the beverage and a paper wine bag for illustrative examples, another objective is to position the wine bottle so that sound-emitting unit is not activated solely by the weight of a wine bottle. A further objective is to locate different size wine bottles so that the sound emitting device is not muffled. A still further objective is to avoid any permanent attachments to the wine bag so that it can be reused or the sound emitting device readily replaced.

These objectives are realized in a design that can use any common paper wine bag, a commercially available self-contained sound-emitting device with an integral switch, and a custom, but inexpensive plastic, or other material, locator unit. The sound emitting device is placed in the bottom of the bag (herein, the words "top" and "bottom" are used in their usual and customary sense) followed by the locator unit. The commercially available sound emitting device is contained in an approximately matchbox-size plastic box that has a speaker projecting through a spring-loaded top cover and a switch that is actuated by pushing down on the top cover in a defined manner.

The locator has protrusions that position the sound emitting device underneath it in a corner of the bottom of the paper bag with an aperture for the speaker. The locator has raised bottle slides with selected radii and position for the center of the radii that act as bottle positioners. The radii center is positioned on the other side of a locator center line than the speaker. As a result of the bottle locating design, large wine bottles do not cover the speaker nor actuate the switch unless pressed down. The locator is adequately stiff so that a small wine bottles located away from the sound emitting device will still activate the switch when they are pressed down.

Provisions are made for the sound emitting device to be demountably retained by the locator so that merchants can separately stock wine bags, locators and sound emitting devices with different outputs.

DESCRIPTION OF THE VARIOUS VIEWS

FIG. 1B shows a side cut-away view of the sound emitting device shown in FIG. 1B.

DETAILED DESCRIPTION

Figure 1A:
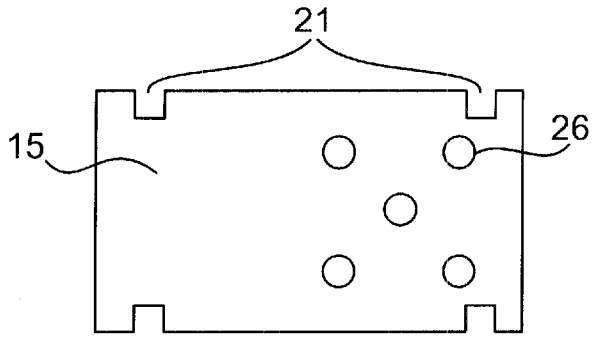
FIG. 1A PRIOR ART
FIG. 1A shows a top view of the cover of a commercially available sound emitting device.
Figure 1B:
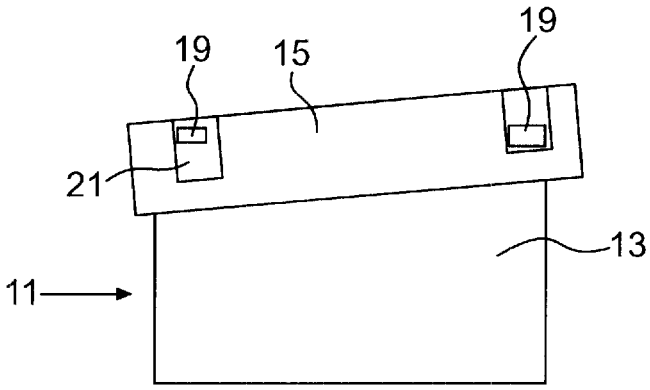
FIG. 1B PRIOR ART
FIG. 1B shows a side view of the sound emitting device in FIG. 1A.
Figure 1C:
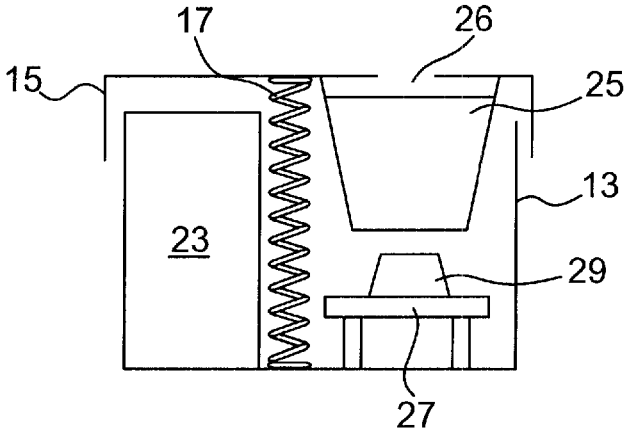
FIG. 1C PRIOR ART

FIG. 1 shows a top, side, and cross-sectional views of a commercially available sound emitting device 11 having approximate dimensions of 1.7×1.2×0.8 inches. The body of the unit has a base 13 and a cover 15 that are forced apart by springs 17. The cover is constrained by projections 19 from the base 13 on each side (two are opposite the two shown in FIG. 1B), each protruding into four slots 21 in the cover 15. For later explanation, in FIG. 1B one end of the cover 15 is shown depressed as far as possible against the bottom 13 while the other end is not depressed. The cross sectional view, FIG. 1C, further shows a battery compartment 23, a speaker 25 affixed to the cover 15 with holes in the cover 26, an IC containing circuit board 27 affixed to the base 13, and a switch 29 affixed to the circuit board 27 and located directly under the speaker 25. The switch is a tactile type similar to those found under hand-held calculator keypads. Connecting wires between the battery, speaker, and circuit board are not shown.

A suitable commercially available unit is a model AS-2009 from Asia Electronic Industries Co., Ltd. (Unit 7, 20/F., Global Trade Ctr., 15 Wing Kin Road, Kwai Chung, Hong Kong—www.asiaindust.com.hk). Smaller units are available, but they are limited to melodies without words.

The sound emitting device is activated as follows. With no pressure on the cover 15, the springs 17 separate it from the base. To play a tune, for example, the cover 15 is pushed against the base 13 forcing the speaker 25 against the switch 29. In order to play the tune again, the switch 29 must be released and depressed. If continuously depressed, the tune plays to the end and stops. As suggested in the side view in FIG. 1B, if the cover 15 is depressed only on the end away from the speaker 25, the switch 29 will not be activated. The speaker end or the entire cover must be depressed.

Figure 2A:
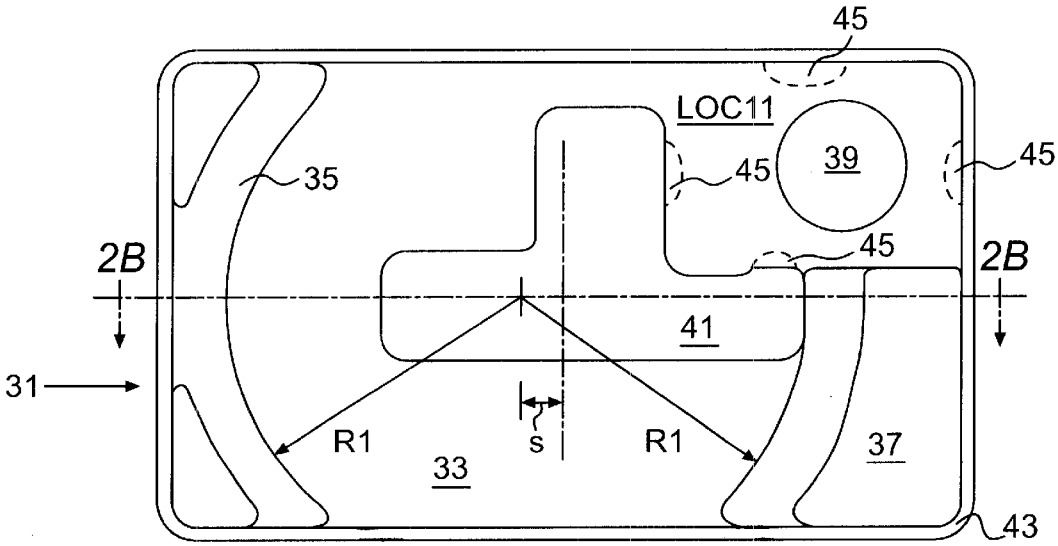
FIG. 2A shows a top view of a locator.
Figure 2B:
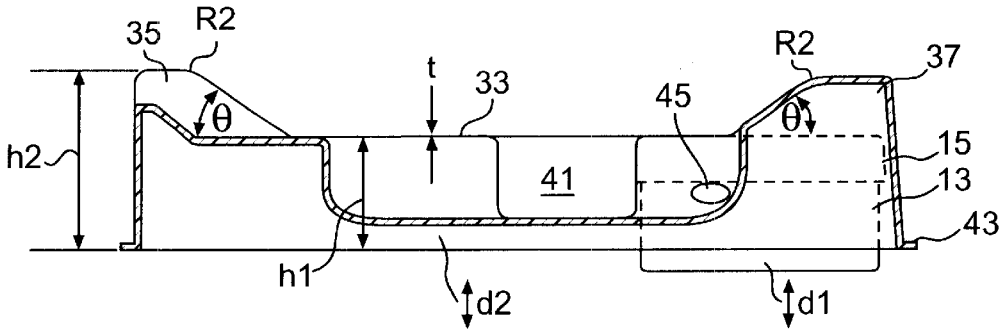
FIG. 2B shows a combined cut-away and cross-sectional view of the locator in FIG. 2A.

FIG. 2 shows a top view and a combined side and cross-sectional view of the locator unit 31, a shell-like structure that can be produced by vacuum forming a polypropylene sheet, for example. The purpose of the locator is to locate both a sound emitting device and a beverage container within a beverage package. The locator illustrated is specially adapted for the sound emitting device illustrated in FIG. 1 and a round bottle such as a wine bottle. It has a bottle surface 33 on which is a long bottle slide 35 and a short bottle slide 37. As shown in FIG. 2A, both bottle slides have a common radius, R1, centered on the center line of the short dimension of the locator but offset a distance, s, from the center of the long dimension. The sound emitting device 11 is under the area designated LOC 11. A speaker aperture 39 is in the bottle surface 33 and there is a downward recess 41 that serves two functions as described below. From the cross sectional view, FIG. 2B, it can be seen that bottle slides 35 and 37 make a slope θ with the bottle surface 33 and have radii in the corners of R2.

Referring to FIGS. 1 and 2, the sound emitting device 11 under LOC 11 has its speaker holes 26 aligned with the speaker aperture 39. The locator shell is compliant enough so that the sound emitting device cover can be forced past the shell indents 45 that protrude under the sound emitting device cover 15 to hold the sound emitting device in place. The sound emitting device purposely protrudes a distance, d1, from the bottom of the locator unit. The distance, d1, must be large enough so that the locator 31 can cause the sound emitting device top 15 to traverse the actuation (off-to-on) region of the switch 29. Having d1 larger than the length of the slot 21 is not useful. Preferably, d1 should be as small as possible to avoid excessively tilting the wine bottles. Since the springs 17 are pre-loaded with the weight of a wine bottle, they are slightly compressed and so d1 can be smaller than the slot length. (The springs must be strong enough so that wine bottle weight alone will not activate the switch 29.) After some experimentation with a selected sound emitting device, the minimum d1 can be determined.

In a vacuum forming process, the thickness of the locator 31 depends on the starting thickness of the sheet stock and how much it is stretched over the tool. The starting thickness is designated as being a thickness, t, but the thickness of the skirts 43 can be less than half of this. (Notwithstanding that the cross-hatch illustrating section 2B in FIG. 2B is shown as having uniform thickness. Also, t is shown as having too small a thickness.) The function of the recess 41 is to locate the sound emitting device 11 in the horizontal direction and provide two of the horizontal indents 45 for location in the vertical. However, the recess 41 adds considerable stiffening to the structure of the locator 31. The amount of stiffening will, in general, be a function of the depth of the recess (the width is much less important), but it must clear the bottom of the locator unit by a distance, d2. This is so that when the locator is pressed down to activate the switch 29, a wine bag that may be uneven does not interfere with the bottom of the recess 41.

Figure 3:
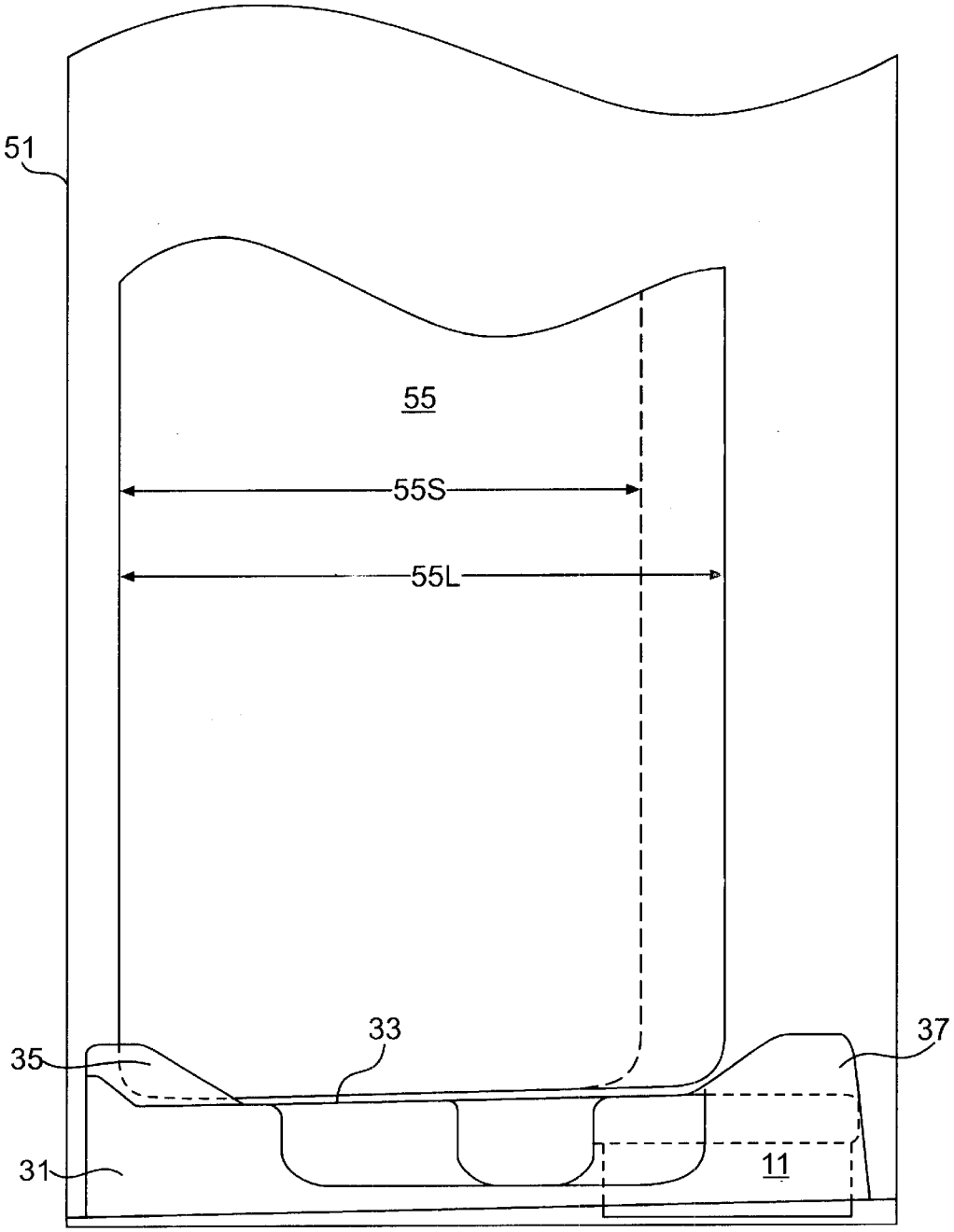
FIG. 3 illustrates a cross-section of an assembly of a sound emitting device of FIG. 1 inside the locator of FIG. 2, both inside a beverage carrier with beverage containers disposed on the locator.

FIG. 3 illustrates the bottom portion of a cross-section of a wine bag 51 having a bottom 53, on which is disposed the locator unit 31 enclosing a sound emitting device 11 underneath. A wine or similar bottle 55 is disposed on the locator bottle surface 33 between the bottle slides 35 and 37. As shown, bottles 55S and 55L with two different diameters are illustrated corresponding approximately to a 750 ml size standard wine bottle and the same volume larger champagne bottle from a particular manufacturer.

Assembly and operation in a wine bag 51 is as follows. The sound emitting device 11 is placed in the locator 31 with its speaker holes 25 directly under the speaker aperture 39. As illustrated in FIG. 2B, the sound emitting device 11 protrudes a distance, d1, below the locator skirts 43. This assembly is placed in the bottom of the wine bag 51 with the sound emitting device 11 and portions of the skirts 43 resting on the bag bottom. A wine bottle 55 is placed on top of the locator unit. As shown, a large bottle 55L would be centered between the bottle slides, but a smaller one 55S could be located at the side furthest from the sound emitting device 11.

To work properly, the static weight of the largest bottle 55L should not be enough to activate the switch 29 in the sound emitting device. Otherwise, the unit will play once and not repeat, even if the bottle is pressed down. On the other hand, pressing down on the smallest bottle 55S should activate the switch even if it is located furthest from the switch, as illustrated. The problem of small bottle activation cannot be solved by locating the sound emitting device 11 more centrally, because then the speaker 25 would be covered by larger bottles and muffled.

Because of the need to locate the speaker 25 at an extreme corner LOC 11, the locator unit 31 must be stiff enough to depress the speaker end of the sound emitting device 11 when a small bottle 55S is pushed down on the opposite end of the locator. Very large volume production, e.g., 100 thousand units, might justify the cost of a mold for an injection molding process. In that case, stiff plastics such as polycarbonates could be used. In the case of vacuum formed polypropylene, however, the downward recess 41 is needed for stiffness. In one experiment, the recess depth did not leave any clearance, d2. A bottom part was cut off to provide clearance, but this weakened the locator structure so much that pressing on a small wine bottle did not activate the sound emitting device.

It is important that larger bottles 55L placed in the bag at random slide into place away from the speaker aperture 39. This is aided by the slope θ and radii of curvature, R1, of the circular intersection of the bottle slide 35 and 37 slopes with the locator bottle surface 33. The common center of curvatures of the bottle slides is offset from the locator 31 center enough so that the speaker aperture 39 remains uncovered.

In one experiment, instead of bottle slides, raised rings were used. This was not satisfactory because in some cases smaller bottles placed in the bag settled into a position with part of their bottom on the raised ring and part on the bottle surface 33. It was found that using adequate radii, R2, at the top of the slides and an angle, θ, that was considerably less than 90 degrees caused bottles to slip off the top of the slides 33 and slide down into position.

After some experimentation with prototypes, it was found that the following dimensions worked reasonably well: t=0.060 in.; R1=1.7 in.; R2=¼ in.,θ=30 degrees; d1=3/32 in.; d2=⅛ in.; s=0.25 in.; h1=⅝ in.; and h2=1 in. these should not be considered as exact values; some variation is possible, of course. For example, bottles would still be guided into position on the bottle surface 33 if the angle, θ, were somewhat larger (steeper), e.g., 45°, but the height, h2, were also increased.

Having described the preferred embodiment at the time of filing, it should be noted that the basic design can be adapted to other packages and manufacturing methods. For example, light cardboard or even cloth beverage packages are sometimes used. In this case, the locator should intersect the perimeter of the bottom of such package.

In addition to manufacturing the locator from plastic, sheet metal or wire frames could be used as long as stiffness and geometrical form factors are obtained. Another possibility is to use cardboard. Curved shapes can be accomplished by impregnating with wax, heating with steam, and forming on a mold in a manner similar to vacuum forming.

Instead of demountably retaining the sound emitting device in the locator, adhesives could be used to effect a more permanent mounting if retrofitting is not needed.

Commonly available wine bags have a rectangular bottom with more than adequate room in the long dimension for wine bottles. In the case of a beveraage carrier with a bottom area small enough to put space at a premium, the beverage container slide opposite the speaker aperture could be omitted and that side of the beverage carrier used for positioning.

Lastly, although an advantageous choice, the invention is not limited to the use of the particular commercially available sound emitting device specified herein and used for prototype development. A different form factor or switch arrangement would require obvious modifications to the locator.

It should be understood that this detailed description does not prevent inclusion of other equivalent embodiments within the purview of the invention that is defined by the following claims.

What is claimed is:

1. A beverage package for beverage containers having a minimum and maximum sizes and having a sound emitting device comprising:

a) a beverage carrier having a bottom;

b) a sound emitting device having a speaker and an integral touch sensitive switch, said device being placed in the bottom of said beverage package; and c) a locator placed in the bottom of said package and having:

1) protrusions in length and width that intersect the perimeter of said package bottom;

2) adequate height to encompass said sound emitting device;

3) an aperture for said speaker of said sound emitting device;

4) at least one sound emitting device retainer;

5) at least one beverage container slide; and 6) adequate stiffness so that downward pressure on said locator from a minimum size beverage container will actuate said sound emitting device switch.

2. The beverage package of claim 1 wherein said beverage containers are wine bottles.

3. The beverage package of claim 1 wherein said beverage carrier is a paper bag.

4. The beverage package of claim 1 wherein said beverage carrier is a cloth bag.

5. The beverage package of claim 1 wherein said beverage carrier is a cardboard box.

6. The beverage package of claim 1 wherein said sound emitting device is contained in a base and a spring loaded cover and said integral switch is internal and actuated by pressing said spring loaded cover in the direction of said base.

7. The beverage package of claim 1 wherein said locator is manufactured from vacuum molded plastic.

8. The beverage package of claim 1 wherein said locator is manufactured from injection molded plastic.

9. The beverage package of claim 1 wherein said locator is manufactured from sheet metal.

10. The beverage package of claim 1 wherein said locator is manufactured from a wire frame.

11. The beverage package of claim 1 wherein said locator is manufactured from wax impregnated cardboard.

12. The beverage package of claim 1 wherein said locator sound emitting device retainer comprises a downward protrusion having lateral protrusions that engage said sound emitting device in a retaining manner.

13. The beverage package of claim 1 wherein said locator sound emitting device retainer comprises adhesives affixed to said locator and said sound emitting device.

14. The beverage package of claim 1 wherein said adequate stiffness is provided for said locator using at least one downwardly protruding recess.

15. The beverage package of claim 1 wherein said at least one beverage container slide comprises an upward protrusion disposed essentially between said speaker aperture and an approximate center of said locator and having a center of a radius of curvature displaced away from said speaker aperture so that said aperture is not covered by beverage containers having said maximum size.

16. The beverage package of claim 1 wherein said at least one beverage container slide comprises a first upward protrusion disposed essentially between said speaker aperture and an approximate center of said locator and a second upward protrusion disposed essentially at the end of said locator antipodal to said speaker aperture, said first and second protrusions having a common center of radii of curvature displaced away from said speaker aperture so that said aperture is not covered by beverage containers having said maximum size.

17. A package for wine bottles having minimum and maximum diameters and having a sound emitting device comprising:

a) a wine bag having a bottom;

b) a sound emitting device having a speaker and an integral touch sensitive switch, said device being placed in the bottom of said beverage package; and c) a locator placed in the bottom of said package and having:

1) protrusions in length and width that intersect the perimeter of said package bottom;

2) adequate height to encompass said sound emitting device;

3) an aperture for said speaker of said sound emitting device;

4) at least one sound emitting device retainer;

5) at least one wine bottle slide; and 6) adequate stiffness so that downward pressure on said locator from a minimum diameter wine bottle will actuate said sound emitting device switch.

18. The wine bottle package of claim 17 wherein said sound emitting device plays a tune with words.

19. The wine bottle package of claim 17 wherein said sound emitting device retainer comprises horizontal indents that intersect the sound emitting device below its top.

20. The wine bottle package of claim 17 wherein said at least one beverage container slide comprises a first upward protrusion disposed essentially between said speaker aperture and an approximate center of said locator and a second upward protrusion disposed essentially at the end of said locator antipodal to said speaker aperture, said first and second protrusions having a common center of radii of curvature displaced away from said speaker aperture so that said aperture is not covered by wine bottles having said maximum diameter.

* * * * *